United States Patent [19]

Rhodes

[11] Patent Number: 4,610,100

[45] Date of Patent: Sep. 9, 1986

[54] SHOE WITH REPLACEABLE HEEL

[76] Inventor: Clifford A. Rhodes, 9101 Golden Gate Blvd., Polk City, Fla. 33868

[21] Appl. No.: 781,854

[22] Filed: Sep. 30, 1985

[51] Int. Cl.[4] ..... A43B 21/36

[52] U.S. Cl. ..... 36/42; 36/36 A; 36/40

[58] Field of Search ..... 36/41, 42, 40, 36 R, 36/36 A, 36 B

[56] References Cited

U.S. PATENT DOCUMENTS

| | | | |
|---|---|---|---|
| 1,888,617 | 11/1932 | Bridi | 36/42 |
| 2,431,868 | 12/1947 | Gilmour | 36/42 |
| 2,556,842 | 6/1951 | Gilmour | 36/42 |
| 2,582,551 | 1/1952 | Malherbe | 36/42 |
| 2,795,867 | 6/1957 | Zuckerman et al. | 36/42 |
| 2,806,302 | 9/1957 | Sharpe | 36/42 |
| 3,193,949 | 6/1965 | Cortina | 36/42 |
| 3,318,025 | 5/1967 | Antelo | 36/42 |
| 3,754,340 | 8/1973 | Pais | 36/42 |
| 4,214,384 | 7/1980 | Gonzalez | 36/42 |

FOREIGN PATENT DOCUMENTS

| | | | |
|---|---|---|---|
| 2519849 | 7/1983 | France | 36/42 |
| 2923926 | 12/1980 | German Democratic Rep. | 36/42 |
| 14298 | of 1909 | United Kingdom | 36/42 |
| 2532456 | 6/1926 | United Kingdom | 36/42 |

*Primary Examiner*—Werner H. Schroeder
*Assistant Examiner*—Mary A. Ellis

[57] ABSTRACT

The shoe has a permanently affixed heel plate attached to the bottom of the heel support portion of the shoe. This heel plate contains a mortise having a decreasing transverse width from the front to the rear of the heel plate. A replaceable heel having a flat surface on one side and a dovetail on the reverse surface corresponding in shape to the opening in the mortise is slid into the mortise to be firmly seat by a friction fit on the heel plate.

10 Claims, 16 Drawing Figures

SHOE WITH REPLACEABLE HEEL

DESCRIPTION

1. Technical Field

This invention relates to a shoe having a replaceable heel. More specifically, it refers to a shoe having a two component heel, one permanently mounted to the lower surface of the shoe and the other slidably engageable with the first component.

2. Background Art

Although replaceable heels are known in the prior art as seen from U.S. Pat. Nos. 1,237,893; 1,435,797; and 1,490,797, such prior art heels suffer from their inability to remain on the shoe or in becoming loose after wear. The replaceable heel in U.S. Pat. No. 1,237,893, has a block which fits into a depression in the permanent portion of the heel. U.S. Pat. No. 1,435,797 describes tabs, flanges and projecting spurs on the permanent portion of the heel engageable with slots on the replaceable heel. U.S. Pat. No. 1,490,797 describes a V-shaped groove contained within a leather lift. The replaceable heel portion contains a lug which fits into an opening in the lift. A force placed on the rear of the heel will not easily disengage the replaceable heel from the rest of the shoe because of the locking tab. An easily replaceable heel would provide a means for a person to change heel heights or styles and replace worn heels or wear pads. However, such a replacement heel must fit securely on the shoe and not be subject to disengagement when the wearer is in a walking mode.

SUMMARY OF THE INVENTION

I have invented a new type replaceable heel that is useful in both men's and women's shoes. The heel comprises two parts. One is a heel plate permanently affixed to the bottom of the shoe and having at least one mortise extending from the front of the plate in a decreasing transverse width towards the rear of the plate. The second is the replaceable heel having a substantially flat first side and at least one tenon projection on the reverse side corresponding in shape to the space in the mortise. The replaceable heel is slid into place by moving it in the mortise groove of the heel plate until fully seated. Backward pressure during walking keeps the heel seated firmly within the mortise groove, but can be removed by tapping the rear portion of the replaceable heel.

BRIEF DESCRIPTION OF THE DRAWINGS

The present invention may be best understood by those of ordinary skill in the art by reference to the following detailed description when considered in conjunction with the accompanying drawings in which.

DESCRIPTION OF THE PREFERRED EMBODIMENT

Figure 1:
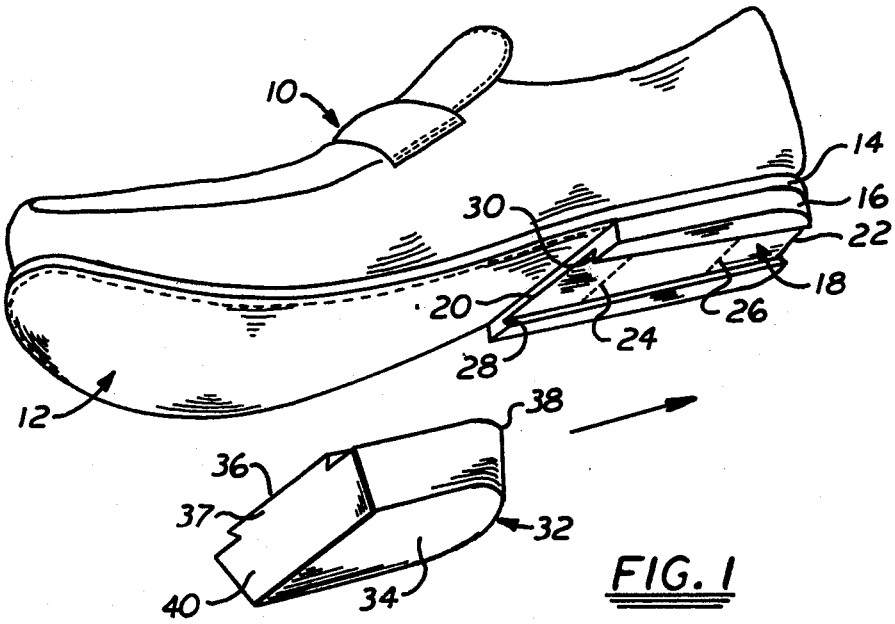
FIG. 1 is a perspective view of a shoe ready to receive a replaceable heal.

Referring first to FIG. 1, the shoe 10 comprises a lower sole 12 extending into an integral rear heel support area 14. A heel plate 16 is either glued, nailed 72 or tacked to the heel support 14 by conventional methods used in the shoe industry. The heel plate 16 has a mortise groove 18 which has a front edge 20 and a rear edge 22 with the front edge 20 wider than the rear edge 22. The mortise groove decreases in width as shown at points 24 and 26 as one moves toward the rear edge 22 having the narrowest width. Flanges 28 and 30 overhang the mortise groove 18 on each side respectively. The replacement part of the heel 32 has a substantially flat first surface 34 that will be in contact with the ground as the person occupying the shoe walks. Of course, one could add spikes or a roughened surface to increase contact with the ground. These additions are contemplated within the term substantially flat as used in the claims. This replaceable part 32 has a reverse side 36 which has a tenon shown as a dovetail-shaped projection 37 on its surface. The dovetail 37 engages the mortise 18 with edge 38 inserted over the front edge 20 of the plate 16. The replaceable part 32 is then slid in a direction as shown by the arrow set forth in FIG. 1 until side 40 of the replaceable heel 32 is flush with edge 20 of the heel plate. As soon as the replacement heel 32 is fully inserted into mortise 18, it will remain firmly affixed by a friction fit. The angled mortise, in effect, provides a friction lock. Movement forward by a person occupying this shoe continues to exert backward pressure on the replacement heel 32 and thereby retains it within the mortise 18. A person desiring to remove the replacement heel 32 needs merely to tap on side 38 vigorously in order to overcome the friction force and move it out of the mortise groove 18 so that a substitute can be inserted.

Figure 2:
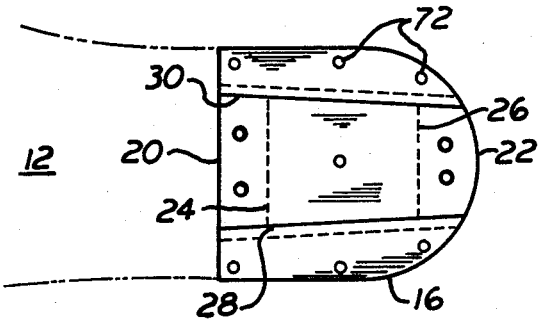
FIG. 2 is a bottom view of a shoe heel with only the heel plate in place.
Figure 3:
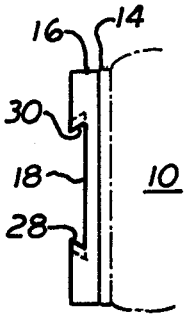
FIG. 3 is a side elevation of the heel of FIG. 2.
Figure 4:
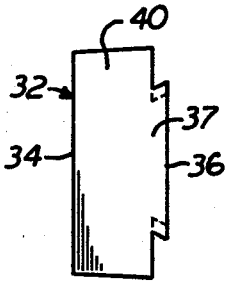
FIG. 4 is a side elevation of the replaceable heel.
Figure 5:
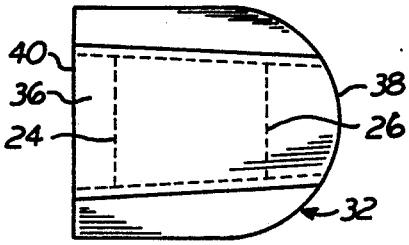
FIG. 5 is a top view of a shoe heel with the replaceable part of the heel in place.

FIGS. 2 and 3 show the heel plate 16 in a condition ready to receive the replaceable heel 32 shown in FIGS. 4 and 5.

Figure 6:
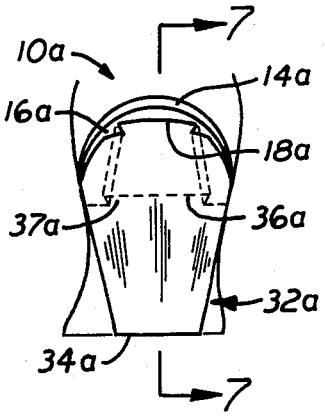
FIG. 6 is a rear view of a woman's shoe with replaceable heel.
Figure 7:
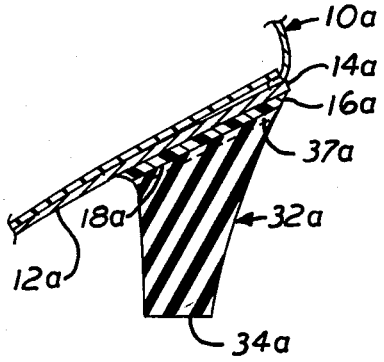
FIG. 7 is a cut away elevation of the shoe shown in FIG. 6.

FIGS. 6 and 7 show a woman's shoe or a shoe having an elevated heel. This shoe 10*a* has a corresponding sole 12*a* that is integral with heel support 14*a*. A permanently affixed heel plate 16*a* is attached to the heel support 14*a* on one side with a mortise groove 18*a* in its other side. In the manner described for the shoe 10 in FIGS. 1 through 5, the replaceable heel 32*a* is designed to have a flat surface 34*a* on its lower side and a dovetail 37*a* on its reverse side. In this type heel 32*a*, the diameter of the heel decreases along its longitudinal axis from the dovetail 37*a* down to the flat bottom surface 34*a*. The replaceable heel dovetail 37*a* is slid into the mortise 18*a* in the same manner as the heel shown in FIGS. 1 through 5.

Figure 8:
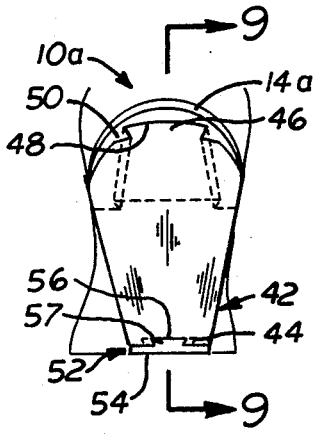
FIG. 8 is a rear view of a replaceable heel and wear pad.
Figure 9:
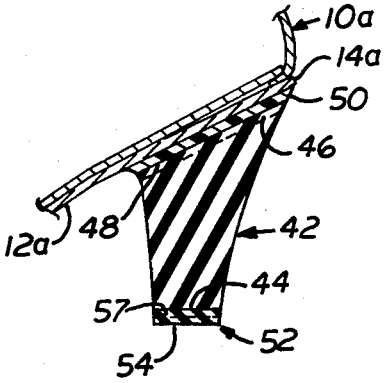
FIG. 9 is a cut away elevation of the shoe shown in FIG. 8.

FIGS. 8 and 9 depict an alternate heel 42 which has instead of a flat surface on a first side a mortise groove 44 and a tenon shown as dovetail 46 on its reverse side which fits into a mortise groove 48 on the heel plate 50. In this design the wear pad 52 has a flat surface 54 on one side and on its reverse side 56 a tenon shown as dovetail 57 which slides into the mortise groove 44. In this design, the wear pad can be replaced as needed but the heel 42 can be retained without the need for wear replacement. In this instance it is believed that replacement would be governed by style and the exact height of the heel 42 which would be desired. See FIGS. 13*a*, 13*b* and 13*c*.

Figure 10:
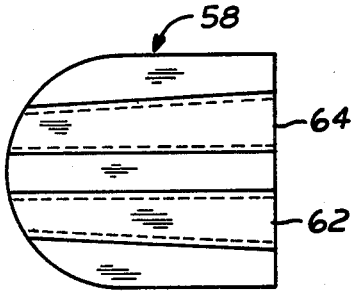
FIG. 10 is a top view of an alternative replacement heel showing two dovetails.
Figure 11:
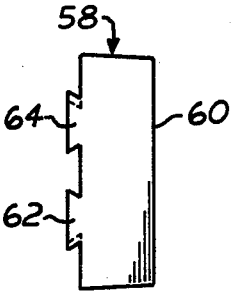
FIG. 11 is a side elevation of the replaceable heel of FIG. 10.
Figure 12:
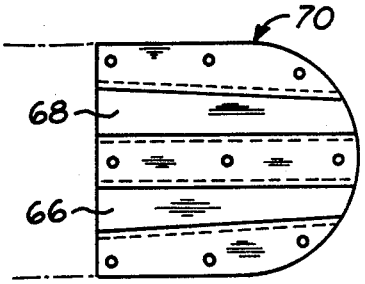
FIG. 12 is bottom view of heel plate with two mortise grooves.

FIGS. 10, 11 and 12 show an alternative design in which the replaceable heel 58 has a flat surface 60 on one side and a pair of tenons shown as dovetails 62 and 64 respectively on the reverse side. These dovetails 62 and 64 fit in mortise grooves 66 and 68 respectively in heel plate 70. This type of design is used in shoes having large heels where a single mortise groove and tenon may not be adequate to hold such a large surface area in place.

Figure 13A:
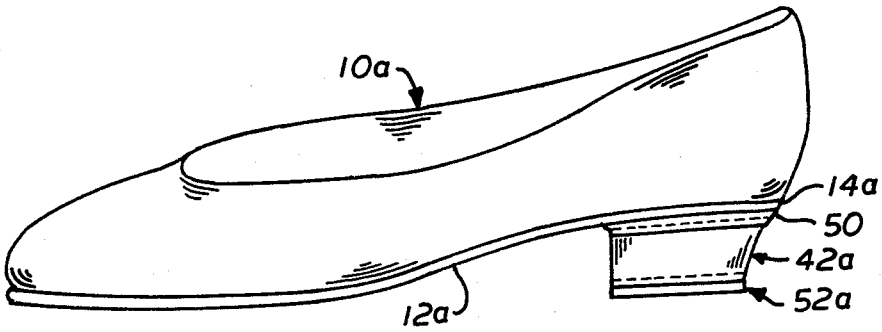
FIG. 13*a* is a perspective view of a woman's shoe with a low height replaceable heel.
Figure 13B:
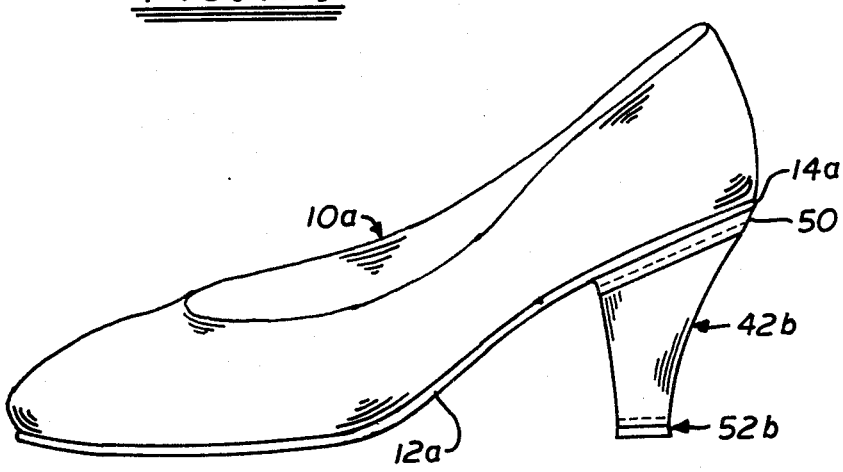
FIG. 13*b* is a perspective view of a woman's shoe with an intermediate height replaceable heel.
Figure 13C:
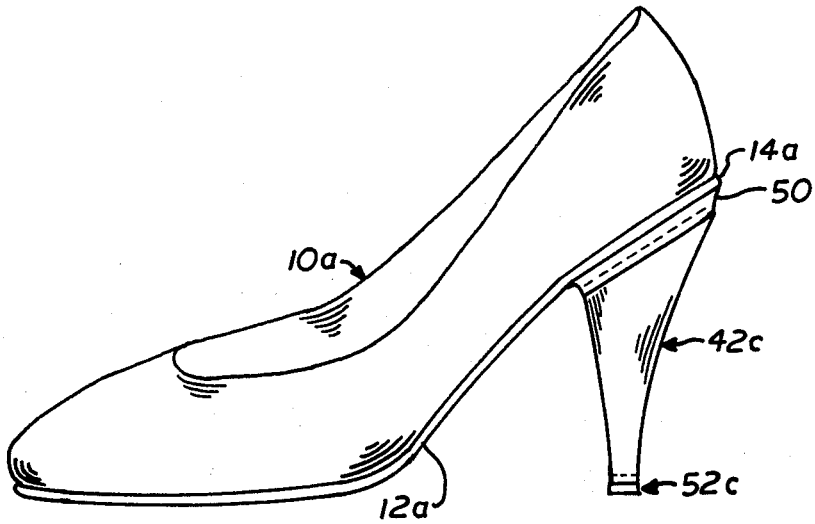
FIG. 13*c* is a perspective view of a woman's shoe with a high replaceable heel.

It is possible that three or even four mortise grooves could also be used with a corresponding number of tenons. However, it is deemed unnecessary to have more than two mortise grooves and corresponding tenons in most shoes. FIGS. 13*a*, 13*b* and 13*c* show respectively the same shoe 10*a*, the same sole 12*a* and same heel plate 50, but with replacement heels 42*a*, 42*b* and 42*c*. These heels differ in height and diameter so that one can replace 42*a* with 42*b* or 42*c*. The same shoe can thereby have varying heights or color heels. Each of these heels have wear pads 52*a*, 52*b* and 52*c* respectively similar to the wear pads shown in FIGS. 8 and 9 previously.

Figure 14:
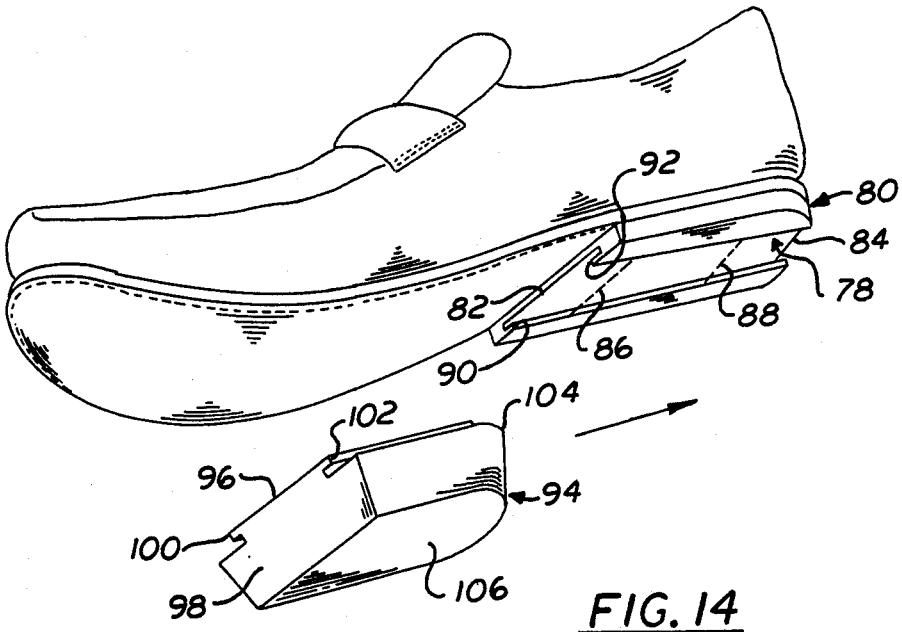
FIG. 14 is a perspective view of a shoe ready to receive a replaceable heel with a T-shaped tenon.

In FIG. 14 an alternate mortise shape and tenon is shown in heel plate 80. The mortise 78 starts at front edge 82 and extends to back edge 84. The width of the mortise groove 78 decreases as shown at points 86 and 88 as one moves from the front to the back of mortise 78. Flanges 90 and 92 overhang mortise 78 and are adapted to receive the T-shaped tenon 96 at the top of replaceable heel 94. Ears 100 and 102 respectively on tenon 96 slide under flanges 90 and 92 on the heel plate 80. The front edge 98 of tenon 96 is wider than the back edge 104 to accommodate to the decreasing width of mortise 78. As in previously described heels the bottom 106 of replaceable heel 94 is flat.

The shoes depicted in this invention can contain the same materials as in conventional shoes with either leather or plastic type uppers. The replaceable heel can be made of wood, aluminum, steel, or plastic having a durometer hardness of about 90 or like material known in the shoe trade. The wear pad would noramlly be made of rubber but can be of leather as desired by the wearer. The replacement heels can be of any color or size desired by the wearer so that various combinations of shoes can be utilized merely by a single investment in one pair of shoes and varied replacement heels. Typical replacement heels for women's shoes could vary in height increments by $\frac{1}{4}$ inch and could start at $\frac{7}{8}$ inches and extend to $4\frac{3}{4}$ inches or possibly higher in exaggerated styles.

Having thus described the invention that is claimed and desired to be secured by Letters Patent is:

1. A shoe having a heel comprising (a) a heel plate permanently affixed to the bottom of a heel support portion of the shoe;

(b) the heel plate conforming to the outer contour of the shoe with a rear edge of the heel plate substantially contiguous with the rear edge of the shoe and having at least one mortise for receiving a corresponding tenon projecting from one surface of a replaceable heel, the mortise extending from a front edge of the heel plate in a decreasing transverse width towards the rear edge of the heel plate;

(c) the replaceable heel having a substantially flat first surface and at least one tenon projection on the upper reverse surface corresponding in shape to a space in the mortise; and (d) the replaceable heel being insertable into the heel plate mortise at the front edge of the heel plate to engage the mortise and then by force in a rearwardly longitudinal direction seating the tenon portion of the replaceable heel into the corresponding space in the mortise.

2. A shoe having a heel according to claim 1 wherein the tenon is a dovetail.

3. A shoe having a heel according to claim 1 wherein the tenon is T-shaped.

4. A shoe having a heel according to claim 2 wherein there is one mortise in the heel plate and one corresponding dovetail on the reverse surface of the replaceable heel.

5. A shoe having a heel according to claim 2 wherein there are two mortises with parallel centerlines in the heel plate and two corresponding dovetails having parallel centerlines on the reverse surface of the replaceable heel.

6. A shoe having a heel according to claim 1 wherein an upper portion of the replaceable heel closest to the heel plate conforms to the shape of the heel plate and the heel decreases in diameter thickness in the direction of the lower surface of the heel.

7. A shoe having a heel according to claim 6 having a replacement wear pad with a flat first surface and at least one tenon projection on the upper surface corresponding in shape to a space in a mortise in the first surface of the replaceable heel.

8. A shoe having a heel according to claim 2 wherein an upper portion of the replaceable heel closest to the heel plate conforms to the shape of the heel plate and the heel decreases in diameter thickness in the direction of the lower surface of the heel.

9. A shoe having a heel according to claim 8 having a replacement wear pad with a flat first surface and at least one dovetail projection on the upper surface corresponding in shape to a space in a mortise in the first surface of the replaceable heel.

10. A shoe having a heel according to claim 6 wherein there is one mortise in the heel plate and one corresponding T-shaped tenon on the upper surface of the replaceable heel.

* * * * *